US010967641B2

(12) United States Patent
Munakata et al.

(10) Patent No.: US 10,967,641 B2
(45) Date of Patent: Apr. 6, 2021

(54) LIQUID EJECTING APPARATUS

(71) Applicant: SEIKO EPSON CORPORATION, Tokyo (JP)

(72) Inventors: Manabu Munakata, Matsumoto (JP); Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/741,211

(22) Filed: Jan. 13, 2020

(65) Prior Publication Data

US 2020/0223228 A1 Jul. 16, 2020

(30) Foreign Application Priority Data

Jan. 16, 2019 (JP) ..... JP2019-004982

(51) Int. Cl.
*B41J 2/175* (2006.01)

(52) U.S. Cl.
CPC ..... *B41J 2/17506* (2013.01); *B41J 2/1753* (2013.01)

(58) Field of Classification Search
CPC .. B41J 2/17506; B41J 2/1753; B41J 2/17509; B41J 2/17513; B41J 2/17553; B41J 29/13; B41J 2/045; B41J 2/17503
See application file for complete search history.

(56) References Cited

U.S. PATENT DOCUMENTS

2018/0272731 A1* 9/2018 Kimura ..... B41J 29/13

FOREIGN PATENT DOCUMENTS

JP 2016168722 9/2016
JP 2018161851 10/2018

* cited by examiner

*Primary Examiner* — Bradley W Thies
(74) *Attorney, Agent, or Firm* — Workman Nydegger

(57) ABSTRACT

A liquid ejecting apparatus including a liquid ejecting head including a nozzle for ejecting liquid by driving a drive element, an electrical component coupled to the drive element, a liquid storing member including a filling port for injecting the liquid from a refilling container therethrough, the liquid storing member receiving and storing the liquid through the filling port, and a holder mounting the liquid ejecting head, the electrical component, and the liquid storing member. In the liquid ejecting apparatus, the electrical component and the filling port do not overlap each other in plan view.

14 Claims, 11 Drawing Sheets

LIQUID EJECTING APPARATUS

The present application is based on, and claims priority from JP Application Serial Number 2019-004982, filed Jan. 16, 2019, the disclosure of which is hereby incorporated by reference herein in its entirety.

BACKGROUND

1. Technical Field

The present disclosure relates to a liquid ejecting apparatus including a liquid ejecting head such as, for example, an ink jet recording head that ejects a liquid through nozzles and, in particular, relates to a liquid ejecting apparatus that includes, together with a liquid ejecting head and an electrical component, a liquid storing member provided with a filling port configured to refill the liquid therethrough, in a holder.

2. Related Art

A liquid ejecting head is configured to receive a liquid from a liquid storing member, which stores the liquid supplied thereto, and to eject (discharge) the liquid thorough nozzles by driving drive elements such as piezoelectric elements and heating elements. In the liquid ejecting apparatus, such a liquid ejecting head is mounted in a holder, also referred to as, for example, a carriage. Furthermore, in a configuration disclosed in JP-A-2016-168722, an ink tank serving as a liquid storing member is disposed in a casing portion provided on a lateral surface of a liquid ejecting apparatus. Ink that is a type of liquid is stored in the ink tank. A filling port is provided in the ink tank, and the ink can be refilled through the filling port.

Incidentally, in order to reduce the size of the liquid ejecting apparatus, a configuration is also proposed in which the liquid storing member configured in the above manner is mounted in the holder together with the liquid ejecting head, electrical components such as the circuit substrate related to driving of the drive element, and other elements. Typically, the liquid ejecting head and the electrical components are disposed on the bottom surface side of the holder, and the liquid storing member is disposed above the liquid ejecting head and the electrical components. In such a configuration, there has been shortcomings such as short-circuiting caused by a liquid coming in contact with the electrical components when a liquid is spilt while filling the liquid into the liquid storing member through the filling port.

SUMMARY

The present disclosure has been proposed in view of the issue described above and provides a liquid ejecting apparatus including a liquid ejecting head that ejects a liquid thorough a nozzle by driving a drive element, an electrical component electrically coupled to the drive element, a liquid storing member that includes a filling port configured to have the liquid from a refilling container filled therethrough, the liquid storing member receiving and storing the liquid through the filling port, and a holder in which the liquid ejecting head, the electrical component, and the liquid storing member are mounted. In the liquid ejecting apparatus, the electrical component is disposed at a position deviated from the filling port in plan view.

DESCRIPTION OF EXEMPLARY EMBODIMENTS

Figure 1:
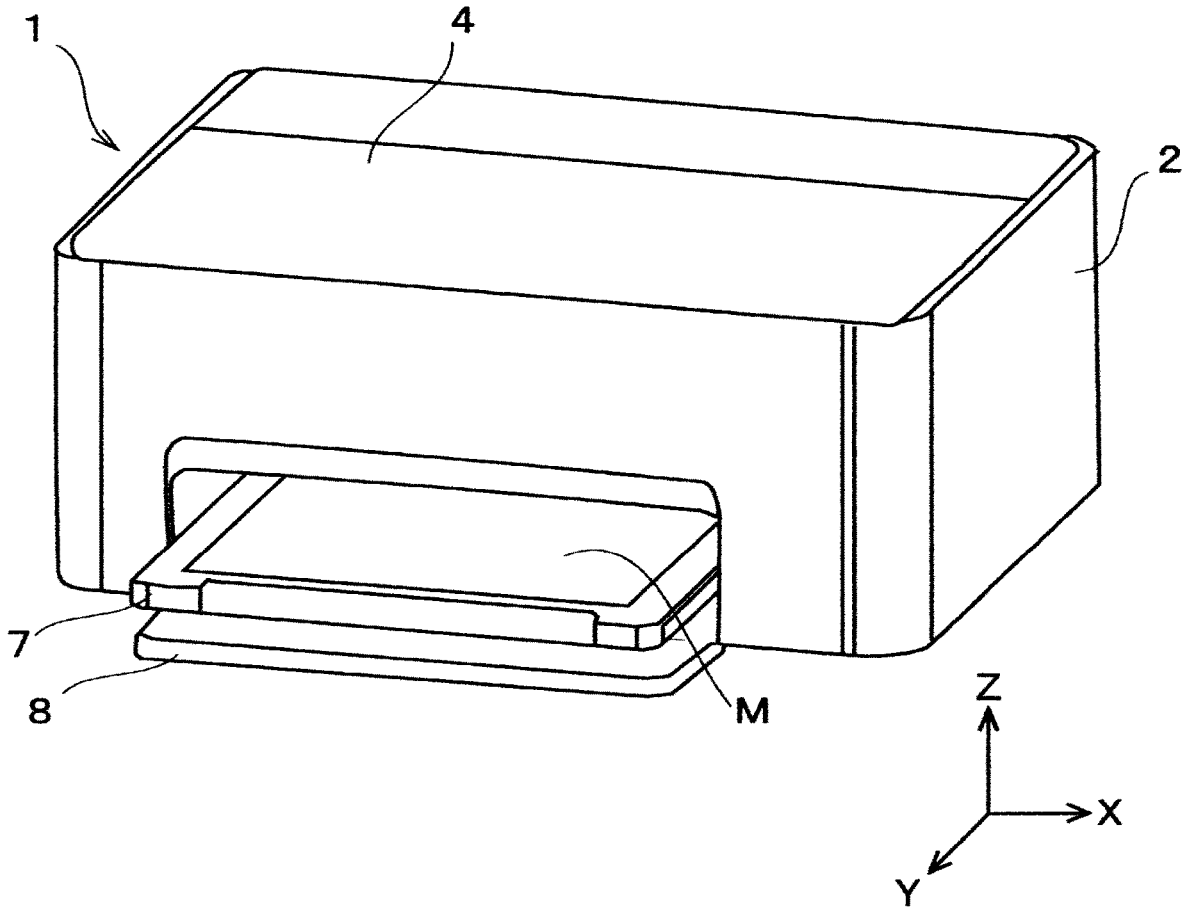
FIG. 1 is a perspective view illustrating a configuration of an embodiment of a liquid ejecting apparatus.

Hereinafter, exemplary embodiments for carrying out the present disclosure will be described with reference to the drawings. Note that in the exemplary embodiments described below, various limitations are set as specific examples suitable for the present disclosure; however, the scope of the present disclosure is not limited to the configurations described below unless there is a description particularly implying that the present disclosure is limited thereby. Furthermore, in the following description, an ink jet recording apparatus, on which an ink jet recording head that is a type of a liquid ejecting head is mounted, will be illustrated as an example of one of the modes of the liquid ejecting apparatus according to the present disclosure. Hereinafter, among an X direction, a Y direction, and a Z direction that are orthogonal to each other, the X direction (corresponding to a second direction in the present disclosure) is a width direction of a medium M, such as a recording sheet, and is a moving direction of a liquid ejecting head 10, in other words, the X direction is a scanning direction. The Y direction (corresponding to a first direction in the present disclosure) is a transport direction of the medium M, or a sub scanning direction, at a position opposing nozzles 35 (see FIG. 9) of the liquid ejecting head 10. An XY plane is a surface parallel to a bottom portion 2*a* of a housing 2 of a liquid ejecting apparatus 1 or is a surface parallel to a nozzle surface (a nozzle plate 32, see FIG. 9) in which the nozzles 35 of the liquid ejecting head 10 are formed, and the Z direction is a direction orthogonal to the nozzle surface or the XY plane. Note that the upstream side in the transport direction of the medium M, or the upstream side in the Y direction, is appropriately referred to as a first side, and the downstream side is appropriately referred to as a second side. Furthermore, the Z direction will be described as a vertical direction with the bottom portion 2*a* of the housing 2 as a reference.

Figure 2:
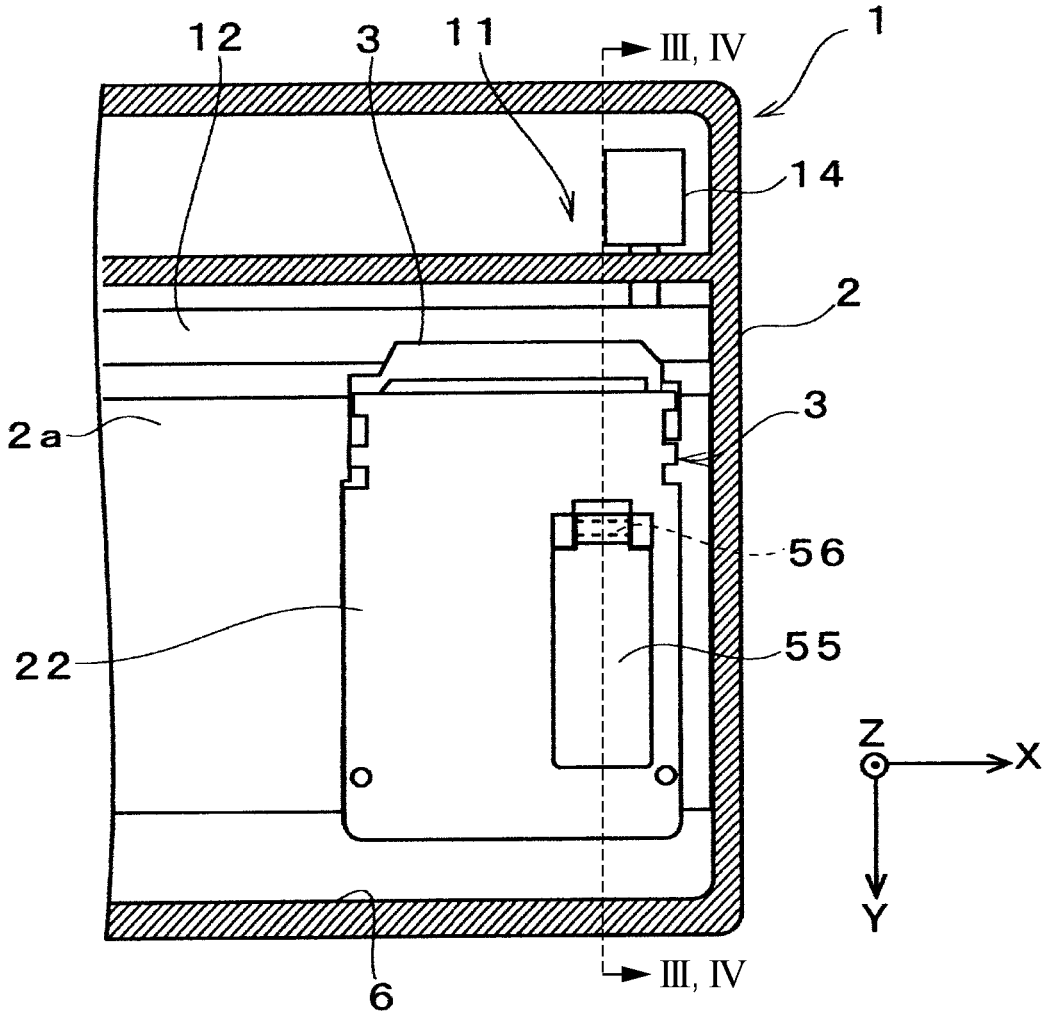
FIG. 2 is a plan view illustrating an inside configuration of a liquid ejecting apparatus according to a first exemplary embodiment.
Figure 3:
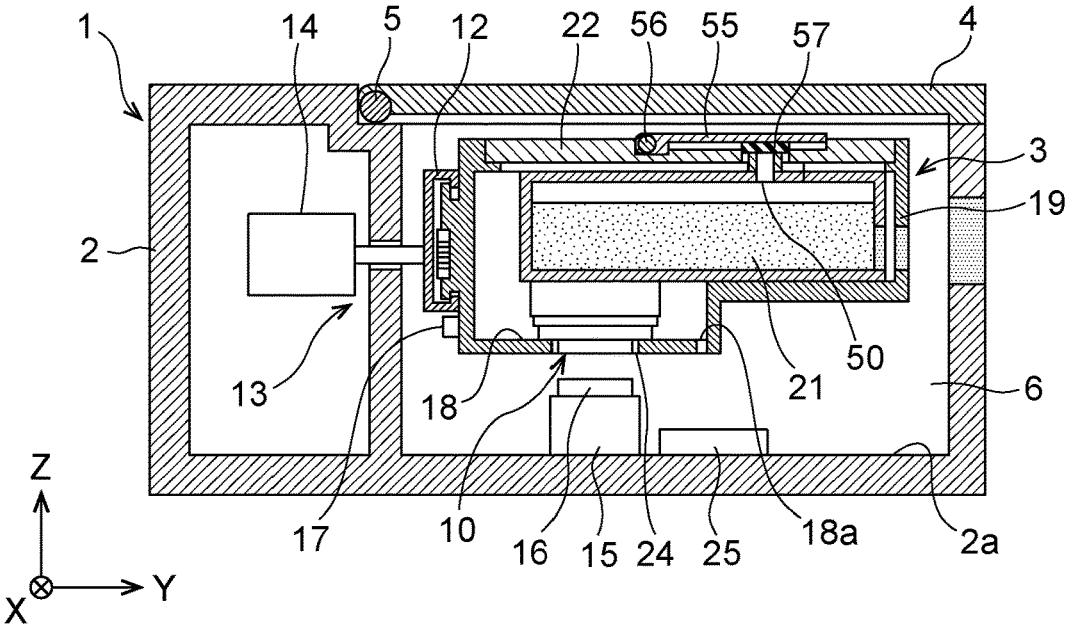
FIG. 3 is a cross-sectional view taken along line III-III in FIG. 2.
Figure 4:
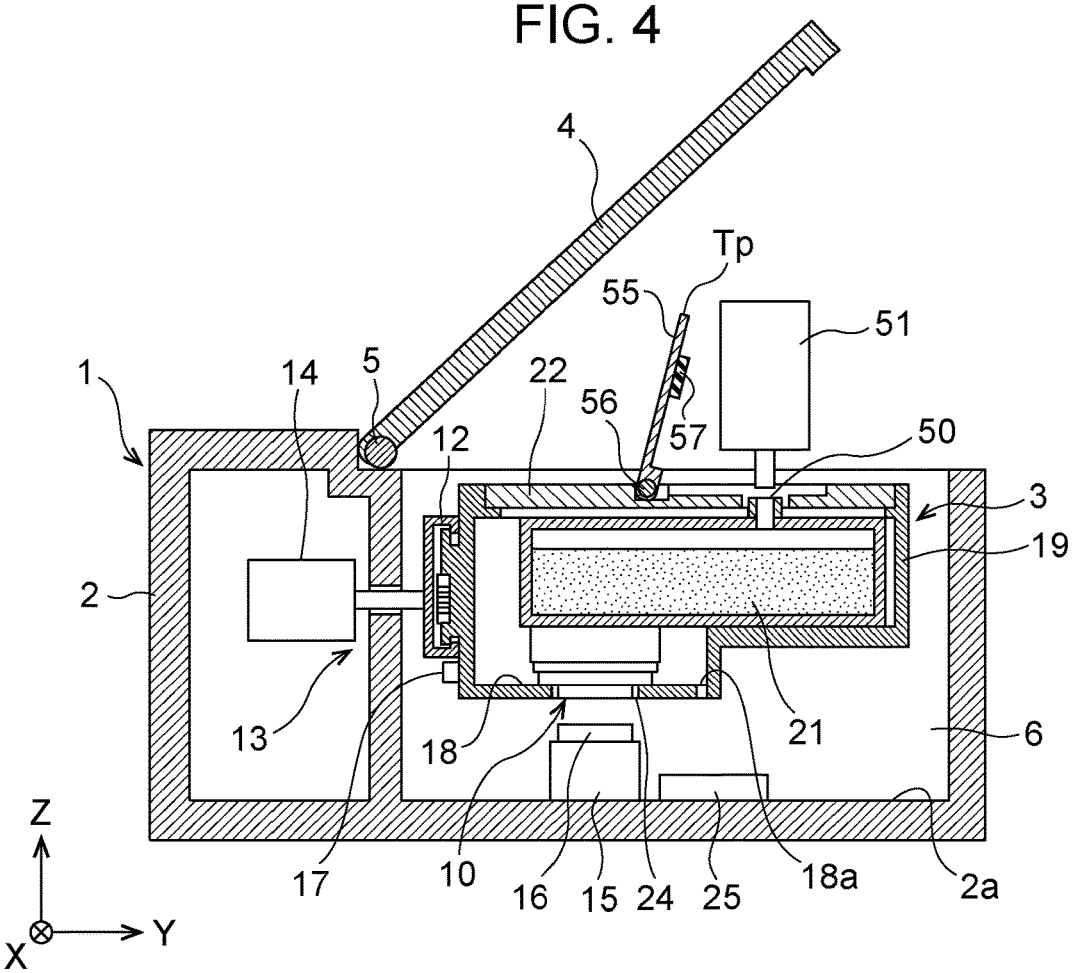
FIG. 4 is a cross-sectional view taken along line IV-IV in FIG. 2.

FIG. 1 is a perspective view illustrating an appearance configuration of the liquid ejecting apparatus 1, and FIG. 2 is a plan view illustrating an internal configuration of the liquid ejecting apparatus 1. Furthermore, FIG. 3 and FIG. 4 are cross-sectional views taken along line III-III and IV-IV, respectively, in FIG. 2. FIG. 3 illustrates a state in which a body cover 4 and a filling port cover 55 are closed, and FIG. 4 illustrates a state in which the body cover 4 and the filling port cover 55 are open. Note that FIG. 2 illustrates a state in which a lid member 22 is attached to an upper surface of a holder 3 and in which the filling port cover 55 is closed.

The liquid ejecting apparatus 1 according to the present exemplary embodiment includes the liquid ejecting head 10 (an ink jet recording head in the present exemplary embodiment) that is mounted in the holder 3 and that is disposed in an internal space 6 of the housing 2 of the liquid ejecting apparatus 1. Images, text, and the like are printed on the medium M by ejecting ink that is a type of liquid through the nozzles 35 of the liquid ejecting head 10 and applying the ink on the medium M (a recording medium or a type of an object being struck with the liquid) such as a recording sheet. The body cover 4 is provided on an upper surface (in other words, a top face) of the housing 2 in the Z direction. As illustrated in FIGS. 3 and 4, an upper surface of the internal space 6 can be opened by lifting up an edge portion of the body cover 4 on the second side in the Y direction (in other words, on the front side of the housing 2) and pivoting the body cover 4 about a body cover pivot shaft 5 disposed on the first side in the Y direction (in other words, on the rear side of the housing 2). When the body cover 4 is open, operations such as refilling the ink into the liquid storing member 21 can be performed. Furthermore, a discharge tray 7 is provided on a front lower side of the housing 2. The medium M on which printing has been performed is discharged on the discharge tray 7. Furthermore, a feed tray 8 configured to be drawn out from the housing 2 is provided below the discharge tray 7. Mediums M such as recording sheets and postcards can be set in the feed tray 8. Note that a configuration in which a scanner is provided above the housing 2 can be adopted as well. In such a case, the scanner functions as a body cover that is configured to open/close the internal space 6.

Other than the holder 3 described above, a holder moving mechanism 11, a capping mechanism 15, a transport mechanism (not shown) that transports the medium M to a portion below the liquid ejecting head 10 mounted in the holder 3, and other members are housed in the internal space 6 of the housing 2. The holder moving mechanism 11 includes a guide frame 12, which is provided in the X direction or the main scanning direction in the internal space 6 of the housing 2, and a carriage motor 14. The holder 3 driven by the carriage motor 14 is configured to reciprocate in the X direction and along the guide frame 12.

A first end portion (the left side in FIG. 2) of a moving area of the holder 3 is a standby position of the liquid ejecting head 10 when a recording operation is not performed. A home position that is a position where the main scanning starts is set at the first end portion. The capping mechanism 15 that is a type of maintenance mechanism is provided at a position that opposes the nozzle surface of the liquid ejecting head 10 at the home position. The capping mechanism 15 includes a cap 16 formed of an elastic member such as an elastomer. The capping mechanism 15 is configured to change between a sealing state (a capping state) in which the cap 16 is made to be in contact with the nozzle surface of the liquid ejecting head 10, and a retreated state in which the cap 16 is separated from the nozzle surface. The capping mechanism 15 is capable of making the inside of the cap 16 have a negative pressure with a pump (not shown) when in the capping state described above and, accordingly, is capable of performing a cleaning operation in which the ink and air bubbles are discharged from the nozzles 35 of the liquid ejecting head 10. Note that a wiping mechanism (not shown) that wipes the nozzle surface, and other members are provided in the maintenance mechanism. Note that in the present exemplary embodiment, the ink is refilled into the liquid storing member 21 at the home position. Accordingly, the home position will also be referred to as an ink filling position, as appropriate. Note that the ink filling position is not limited to the position that is the same as the home position.

Figure 5:
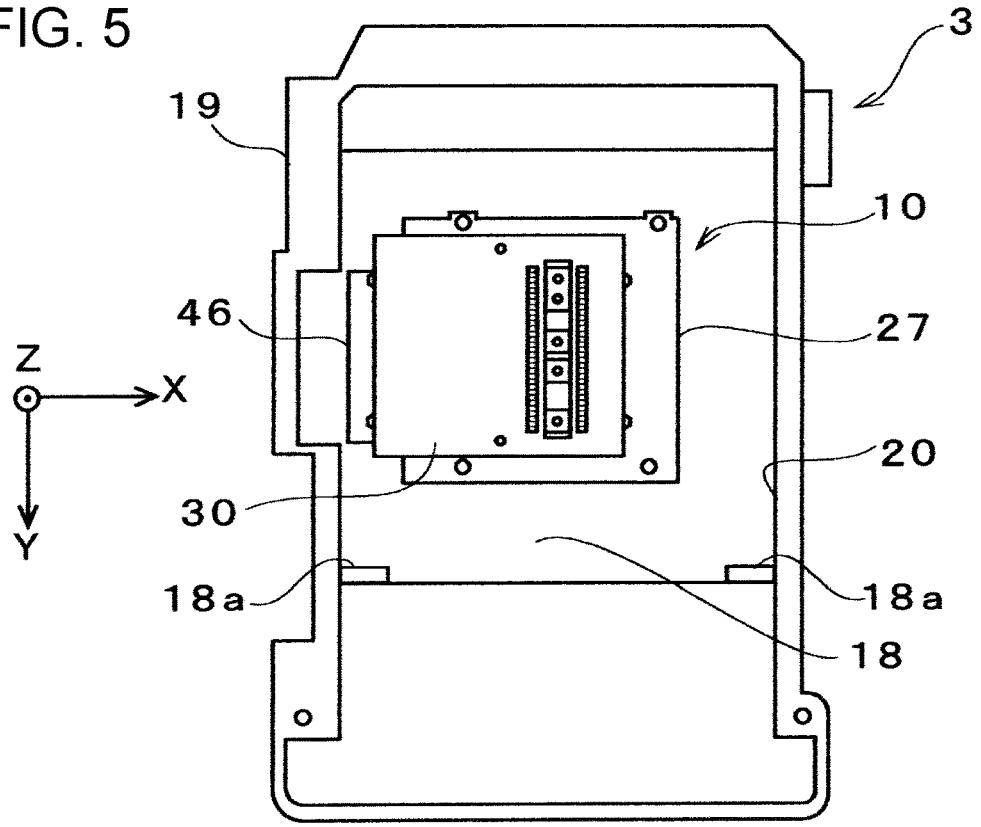
FIG. 5 is a plan view of a holder.
Figure 6:
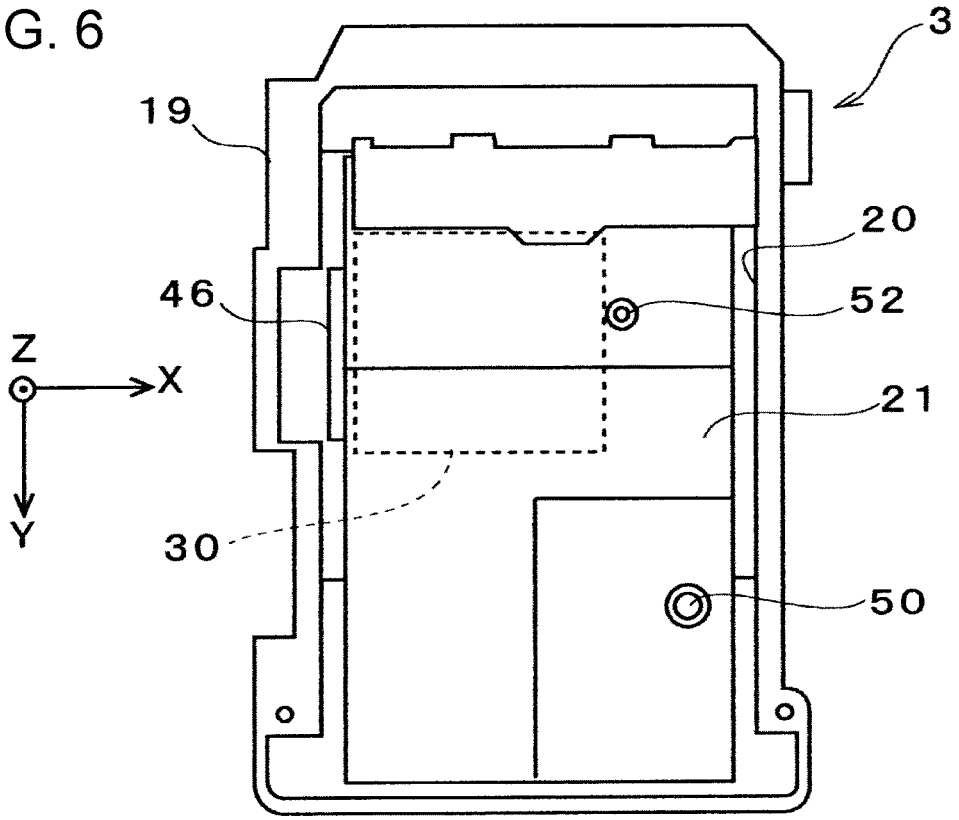
FIG. 6 is a plan view of the holder.
Figure 7:
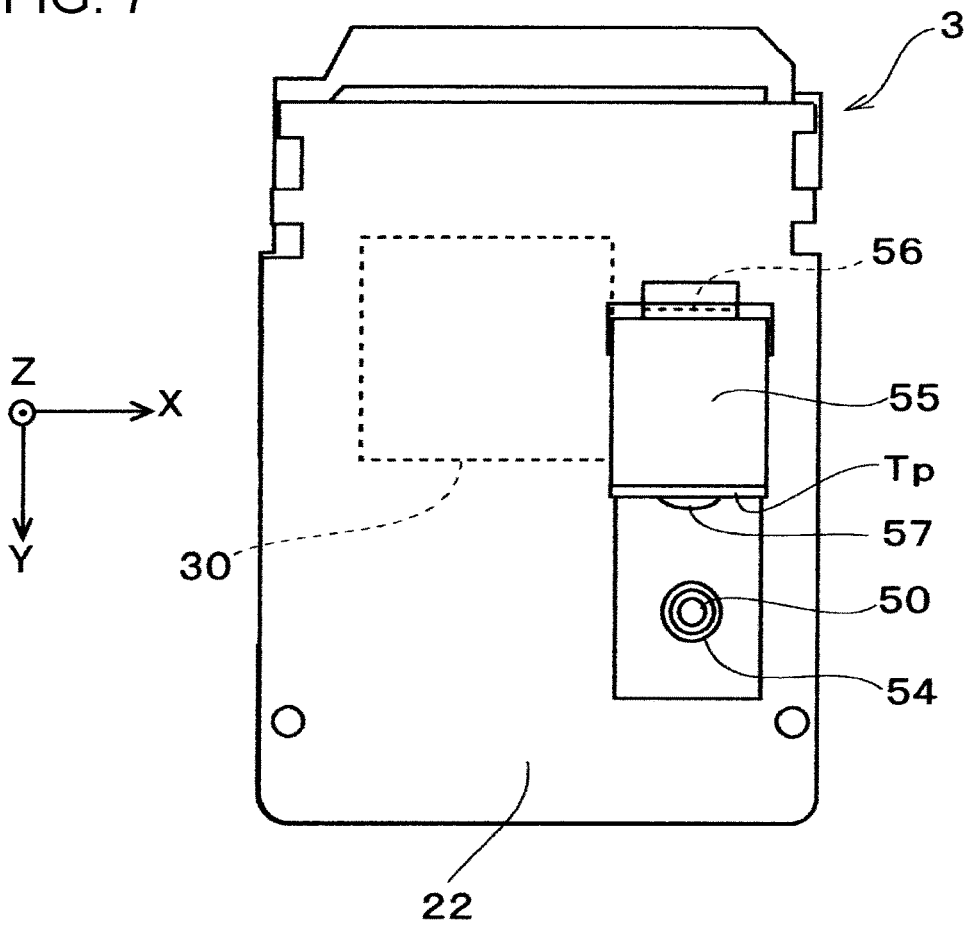
FIG. 7 is a plan view of the holder.

FIGS. 5 to 7 are plan views illustrating a configuration of the holder 3. FIG. 5 illustrates a state in which the liquid ejecting head 10 has been disposed in the holder 3, FIG. 6 illustrates a state in which the liquid storing member 21 has been disposed, and FIG. 7 illustrates a state in which the lid member 22 has been attached. Note that FIG. 5 illustrates a state in which an introduction path unit 28 of the liquid ejecting head 10 has been detached. The holder 3 according to the present exemplary embodiment is a box-shaped member fabricated by, for example, a synthetic resin. The holder 3 includes a bottom plate 18 and lateral walls 19 that extend upwards in the Z direction from the rims of the bottom plate 18. The liquid ejecting head 10 and the liquid storing member 21 are housed inside a housing space 20 defined by the bottom plate 18 and the lateral walls 19. Furthermore, the lid member 22 is attached to the top faces of the lateral walls 19 so that the upper opening of the housing space 20 is closed by the lid member 22.

As illustrated in FIGS. 3 and 4, an insertion opening 24 is open in the bottom plate 18. The insertion opening 24 is a through hole having a size in which a later-described head case 27 of the liquid ejecting head 10 can be inserted and in which the introduction path unit 28 cannot be inserted. When housing and attaching the liquid ejecting head 10 in the housing space 20, the head case 27 is inserted in the insertion opening 24 so that the nozzle surface is exposed from the bottom plate 18 of the holder 3. A through hole 18*a* is formed in the bottom plate 18 at a position on the second side in the Y direction with respect to the insertion opening 24. Furthermore, an absorber 25 formed of a porous material is disposed on the bottom portion 2*a* at a position overlapping the through hole 18*a* in plan view in the Z direction. When refilling the ink in the liquid storing member 21 of the housing 2, even if the ink were to be spilt, the ink will drop through the through hole 18*a* and will be absorbed by the absorber 25. With the above, the spilt ink can be prevented from adhering to electrical components of the liquid ejecting head 10, such as a circuit substrate 30, and to other components in the housing space 20 in which adhering of liquid is to be avoided. Note that the position of the through hole 18*a* is not limited to the position described as an example and may be any position in the Y direction that is within the area from a later-described filling port 50 of the liquid storing member 21 to the electrical components of the liquid ejecting head 10, such as the circuit substrate 30. The same applies to the absorber 25 and the absorber 25 may be disposed inside the housing space 20 of the holder 3, for example.

A medium sensor 17 that detects a leading edge of the medium M is provided on an outer surface of the lateral wall 19 on the first side in the Y direction of the holder 3 of the present exemplary embodiment, in other words, the outer surface of the lateral wall 19 located upstream in the transport direction. The medium sensor 17 includes a light emitting element and a light receiving element, for example. The medium sensor 17 detects the leading edge of the medium M, such as a recording sheet, during the printing operation by emitting a light from the light emitting element towards the downwards side in the Z direction and receiving the reflected light with the light receiving element. Note that while the medium sensor 17 is not electrically coupled to piezoelectric elements 37, the medium sensor 17 is provided in the holder 3 and is related to a liquid ejecting operation performed by the liquid ejecting head 10 and can be said to be a type of electrical component in which adhesion of the liquid is to be avoided.

Figure 8:
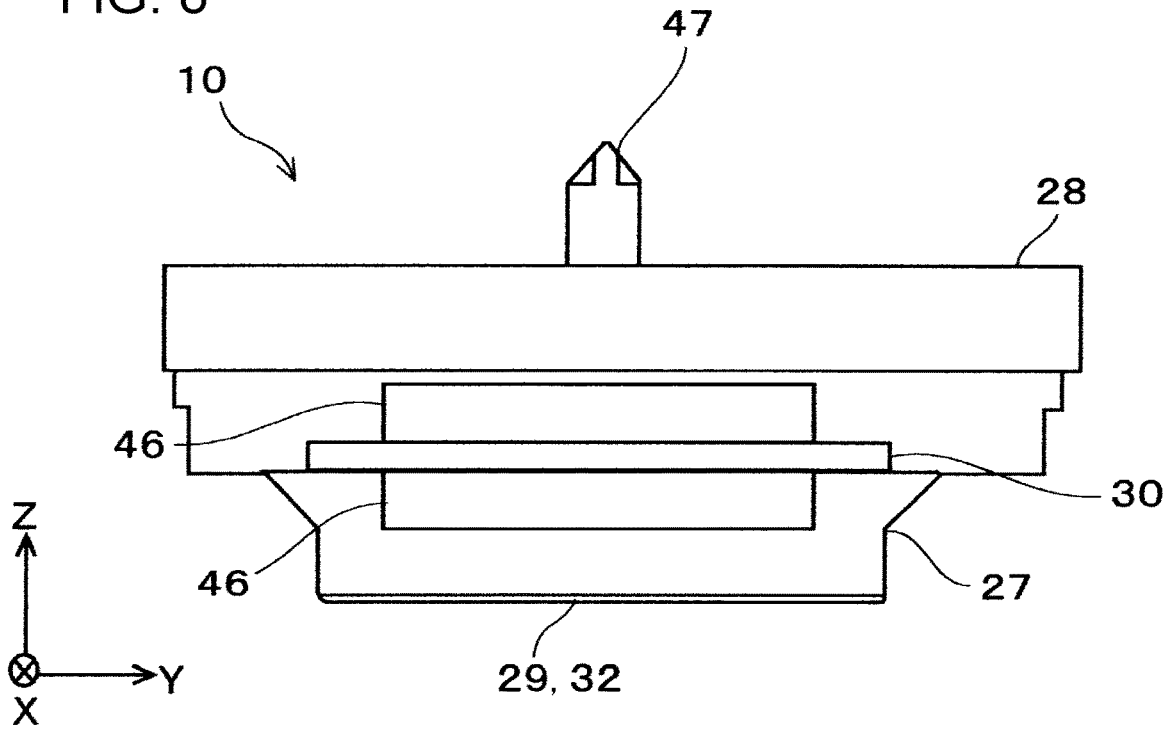
FIG. 8 is a side view illustrating a configuration of an exemplary embodiment of the liquid ejecting head.
Figure 9:
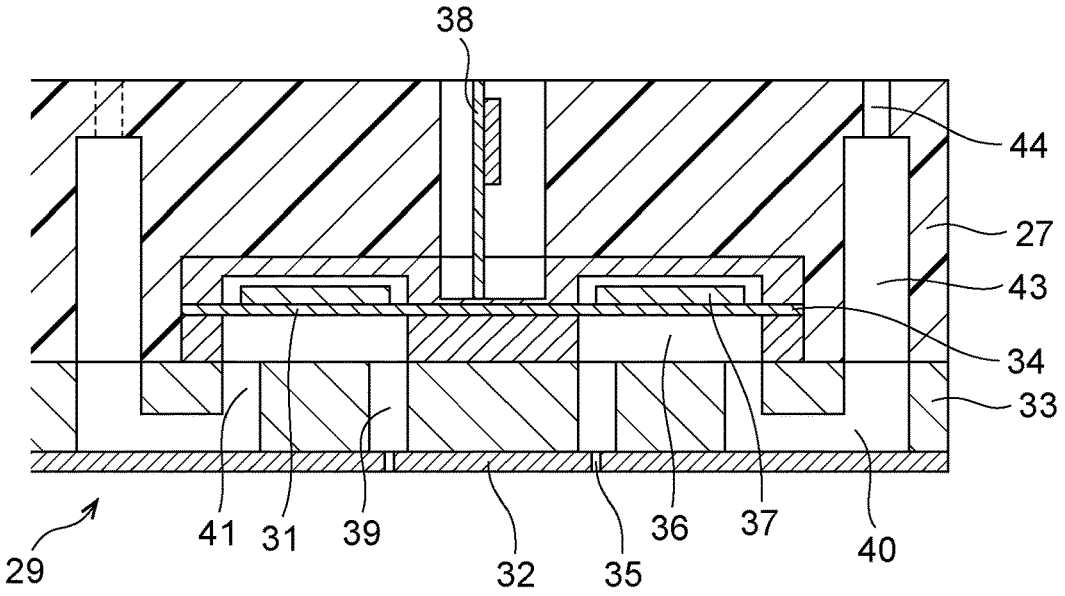
FIG. 9 is a cross-sectional view around a liquid ejecting unit in the liquid ejecting head.

FIG. 8 is a side view of the liquid ejecting head 10. Furthermore, FIG. 9 is a cross-sectional view around a liquid ejecting unit 29 in the liquid ejecting head 10. The liquid ejecting head 10 according to the present exemplary embodiment includes the head case 27, the introduction path unit 28 layered with the circuit substrate 30 interposed between the introduction path unit 28 and an upper surface of the head case 27, and the liquid ejecting unit 29 fixed on an under surface of the head case 27 in the Z direction. The head case 27 is a box-shaped member that is formed of synthetic resin. The liquid ejecting unit 29 is fixed on the under surface side of the head case 27.

The liquid ejecting unit 29 attached to the under surface of the head case 27 is formed as a unit by, as illustrated in FIG. 9, layering and bonding, with an adhesive agent, a plurality of components such as the nozzle plate 32, a communication plate 33, and an actuator substrate 34. The actuator substrate 34 of the present exemplary embodiment includes the plurality of nozzles 35 formed in the nozzle plate 32, a plurality of pressure chambers 36 that are in communication with the nozzles 35, and the plurality of piezoelectric elements 37 that are pressure generating elements that each create a pressure change in the ink inside the corresponding pressure chamber 36 and that are drive elements of the present disclosure. The piezoelectric element 37 is provided in a plural number so as to correspond to the plurality of nozzles 35. A diaphragm 31 is provided between the pressure chambers 36 and the piezoelectric elements 37. A portion of each pressure chamber 36 is sectioned by sealing an upper opening of the pressure chamber 36 with the diaphragm 31. The piezoelectric elements 37 are layered on areas in the diaphragm 31 that correspond to the pressure chambers 36. The piezoelectric element 37 of the present exemplary embodiment is, for example, formed of a lower electrode layer, a piezoelectric layer, and an upper electrode layer (all not shown) that are sequentially layered on the diaphragm 31. A drive signal is applied to each piezoelectric element 37 configured in the above manner from the circuit substrate 30 described later through a wiring member 38 such as a chip-on-film (COF). Furthermore, when a drive signal is applied, the piezoelectric element 37 becomes flexurally deformed when an electric field corresponding to the electric potential difference between the two electrodes is applied between the lower electrode layer and the upper electrode layer.

The communication plate 33 that has an area that is larger than that of the actuator substrate 34 in plan view, which is viewed from a substrate layering direction, is bonded on an under surface of the actuator substrate 34. Nozzle communication holes 39 that communicate the pressure chambers 36 and the nozzles 35 to each other, common liquid chambers 40 commonly provided to the pressure chambers 36, and individual communication holes 41 that communicate the common liquid chambers 40 and pressure chambers 36 to each other are formed in the communication plate 33 according to the present exemplary embodiment. The common liquid chambers 40 are spaces that extend in a direction in which the nozzles 35 are parallelly arranged. The plurality of individual communication holes 41 are formed in a nozzle row direction so as to correspond to the pressure chambers 36. The individual communication holes 41 are in communication with end portions of the pressure chambers 36. The end portions are on the sides opposite the portions of the pressure chambers 36 that are in communication with the nozzle communication holes 39. The nozzle plate 32 in which the plurality of nozzles 35 are formed is bonded to an under surface of the communication plate 33. The nozzle plate 32 is bonded with an adhesive agent or the like to the under surface of the communication plate 33 while in a state in which the nozzle communication holes 39 and the nozzles 35 communicate with each other.

Introduction liquid chambers 43 in communication with the common liquid chambers 40 of the communication plate 33 are formed inside the head case 27 and at both sides interposing the actuator substrate 34 in between. Furthermore, introduction openings 44 in communication with the introduction liquid chambers 43 are open in the upper surface of the head case 27. The ink sent from the introduction path unit 28 is introduced into the introduction openings 44, the introduction liquid chambers 43, and the common liquid chambers 40, and is supplied to the pressure chambers 36 from the common liquid chambers 40 through the individual communication holes 41. Furthermore, in the liquid ejecting unit 29 configured in the above-described manner, in a state in which the flow path from the introduction liquid chamber 43 through the common liquid chamber 40 and the pressure chamber 36 to the nozzle 35 is fully filled with ink, by driving the piezoelectric element 37, a change in the pressure of the ink inside the pressure chamber 36 occur and, owing to the above pressure change (in other words, owing to a pressure oscillation), the ink is ejected from the predetermined nozzle 35. Note that the configurations of the liquid ejecting head 10 and the liquid ejecting unit 29 are not limited to the example configurations and various known configurations can be adopted. A liquid ejecting head configured in various manners such as a liquid ejecting head adopting another pressure generating element, such as a heating element or an electrostatic actuator, as the drive element that ejects ink may be adopted.

The circuit substrate 30 provided between the head case 27 and the introduction path unit 28 is a relay substrate that receives a drive signal from a control circuit (not shown), the control circuit being provided external to the holder 3 and controlling each portion of the liquid ejecting apparatus 1, and that sends the drive signal to the piezoelectric elements 37 through the wiring member 38 (see FIG. 9). In other words, the circuit substrate 30 is electrically coupled to the piezoelectric elements 37 through the wiring member 38. The circuit substrate 30 according to the present exemplary embodiment protrudes from the head case 27 towards a first side in the X direction (the left side in FIG. 5). A connector 46 including a connection terminal for coupling with the control circuit is provided in the above protruded portion. External wiring such as a flexible flat cable (FFC) or an FPC (not shown) is coupled to the connector 46, and the drive signal from the control circuit side is received through the external wiring. The circuit substrate 30, the connector 46, the wiring member 38, and the external wiring that are related to driving the piezoelectric elements 37 are each a type of electrical component of the present disclosure.

The introduction path unit 28 is a member in which an ink introduction path (not shown) that introduces the ink supplied from the liquid storing member 21 to the introduction liquid chambers 43 of the head case 27 is formed. In plan view, the introduction path unit 28 is formed larger than the head case 27. An upper surface of the introduction path unit 28 is a mount area on which the liquid storing member 21 is mounted. An upstream opening portion of the ink introduction path described above is open in the mount area, and an introduction needle 47 is attached to the opening portion with a filter (not shown) in between. The introduction needle 47 is inserted inside the liquid storing member 21 mounted on the mount area, and introduces the ink stored inside the liquid storing member 21 to the liquid ejecting unit 29 side. Note that the configuration in which the introduction path unit 28 introduces the ink is not limited to a configuration using such a needle-shaped introduction needle 47. For example, a configuration of a so-called foam type in which a porous material such as a non-woven fabric or a sponge is disposed in the ink introducing portion of the introduction path unit 28 and a similar porous material is provided in the ink introducing portion of the liquid storing member, and in which sending and receiving of a liquid is performed through capillarity by having the two porous materials come in contact with each other can be adopted.

The liquid storing member 21 is stacked on the liquid ejecting head 10 disposed in the housing space 20 of the holder 3. In the present exemplary embodiment, a single liquid storing member 21 corresponding to black ink is provided in the housing space 20 of the holder 3. The liquid storing member 21 is a tank-shaped member in which the ink supplied to the liquid ejecting head 10 is stored. The filling port 50 is provided in an upper surface, or a top face, of the liquid storing member 21.

As illustrated in FIG. 4, the ink can be poured and refilled from the refilling container 51 into the liquid storing member 21 through the filling port 50. Furthermore, an atmosphere communication hole 52 for taking external atmospheric air into the liquid storing member 21 is formed in an upper surface of the liquid storing member 21. As the ink is consumed by printing, atmospheric air is introduced from the outside into the liquid storing member 21 through the atmosphere communication hole 52. In other words, by replacing the consumed ink with atmospheric air, the pressure inside the liquid storing member 21 is maintained at atmospheric pressure. Furthermore, an output portion (not shown) where the ink is output is provided in a bottom portion of the liquid storing member 21. By having the introduction needle 47 of the liquid ejecting head 10 be inserted in the output portion, the ink inside the liquid storing member 21 is supplied to the liquid ejecting head 10 through the introduction needle 47.

As illustrated in FIGS. 3, 4, and 7, in a state in which the liquid ejecting head 10 and the liquid storing member 21 are attached inside the housing space 20 of the holder 3, the upper opening of the housing space 20 is closed by the lid member 22 attached to the top face of the lateral wall 19. An opening portion 54 (see FIG. 7) that exposes the filling port 50 is provided in the lid member 22 at a position corresponding to where the filling port 50 of the liquid storing member 21 is disposed in the housing space 20. Furthermore, the filling port cover 55 (corresponding to a cover in the present disclosure) configured to pivot about a pivot shaft 56 is attached to the lid member 22. The filling port cover 55 is configured to be displaced about the pivot shaft 56 and between an open position (a state illustrated in FIGS. 4 and 7) in which the filling port 50 is open, and a closed position (a state illustrated in FIGS. 2 and 3) in which the filling port 50 is closed. Furthermore, the filling port 50 exposed to the opening portion 54 is covered by the filling port cover 55 in the closed position. A sealing member 57 (in other words, a cap) formed of an elastic member such as, for example, an elastomer is provided on a back surface of the filling port cover 55 of the present exemplary embodiment, or on a surface opposing the lid member 22 when in a closed state, at a position corresponding to the filling port 50. Accordingly, when the filling port cover 55 is closed, the filling port 50 is sealed with the sealing member 57 in a liquid tight manner so that leakage of ink from the filling port 50 and evaporation of the solvent in the ink are suppressed. Note that in the present exemplary embodiment, while a configuration in which the sealing member 57 is fixed to the filling port cover 55 has been described as an example, not limited to such a configuration, the sealing member 57 may be provided as a cap, which is a member separate to the filling port cover 55. In such a case, it is desirable that a configuration in which the sealing member 57 is fixed to the lid member 22, the filling port cover 55, the liquid storing member 21, or the like with a string-shaped member formed of a material that is the same as that of the sealing member 57, or of another flexible or elastic material, in between is adopted. With the above, the sealing member 57 can be prevented from being lost when the sealing member 57 is detached from the filling port 50 to refill the ink.

In the liquid ejecting apparatus 1 configured in the above manner, when the ink is refilled into the liquid storing member 21 at the ink filling position, as illustrated in FIG. 4, the filling port 50 of the liquid storing member 21 becomes exposed by having the body cover 4 be opened to open the upper opening of the housing space 20 and by having the filling port cover 55 of the holder 3 be opened by being pivoted about the pivot shaft 56. In such a state, the ink in the refilling container 51 is filled into the liquid storing member 21 through the filling port 50. Note that the liquid ejecting apparatus 1 according to the present exemplary embodiment has a feature in that, regarding the positional relationship between the electrical components such as the circuit substrate 30 described above and the filling port 50, the electrical components are disposed at positions deviated from the filling port 50 in plan view in the Z direction (in other words, a direction orthogonal to the nozzle plate 32, which is the nozzle surface, or to the bottom portion 2*a* of the housing 2). More specifically, the filling port 50 is disposed at a position deviated towards the second side in the Y direction from the electrical components such as the circuit substrate 30 that are disposed on the first side in the Y direction, in other words, disposed more to the body cover pivot shaft 5 side of the housing 2. In other words, when viewed in the vertical direction, the filling port 50 and the electrical components are disposed away from each other so as not to overlap each other. With the above, even when the ink is spilt when filling the ink into the filling port 50 from the refilling container 51, the spilt ink can be prevented from adhering to the electrical components. As a result, shortcomings such as short-circuiting due to adhesion of ink to the electrical components can be prevented from occurring.

Furthermore, as illustrated in FIGS. 4 and 7, in the present exemplary embodiment, a distal end Tp of the filling port cover 55 opposite the end portion attached to pivot shaft 56 is, when in the open position, positioned between the electrical components, such as the circuit substrate 30, and the filling port 50 in the Y direction. With the above, the filling port cover 55 blocks the refilling container 51 from entering the electrical component side when the ink is filled into the filling port 50 from the refilling container 51. Accordingly, since the refilling container 51 is prevented from being positioned above the electrical components, the ink is further prevented from contacting the electrical components when the ink is spilt. When the closed position of the filling port cover 55 is 0°, the filling port cover 55 in the open position is, preferably, within a range of 75° to 135°, inclusive, about the pivot shaft 56. With the above, the distal end Tp of the filling port cover 55 in the open position is oriented upwards and the refilling container 51 is prevented in a more effective manner from being positioned above the electrical components when the liquid is filled into the filling port 50 from the refilling container 51. Note that in the present exemplary embodiment, the angle of the filling port cover 55 in the open position is, in the angle range described above, set to less than 90°. With the above, even when the pivot shaft 56 is disposed at a position overlapping the electrical components, such as the circuit substrate 30, in plan view in the Z direction, since the distal end Tp of the filling port cover 55 in the open position is, in the Y direction, positioned between the electrical components and the filling port 50, the refilling container 51 can be prevented from entering the electrical component side.

Figure 10:
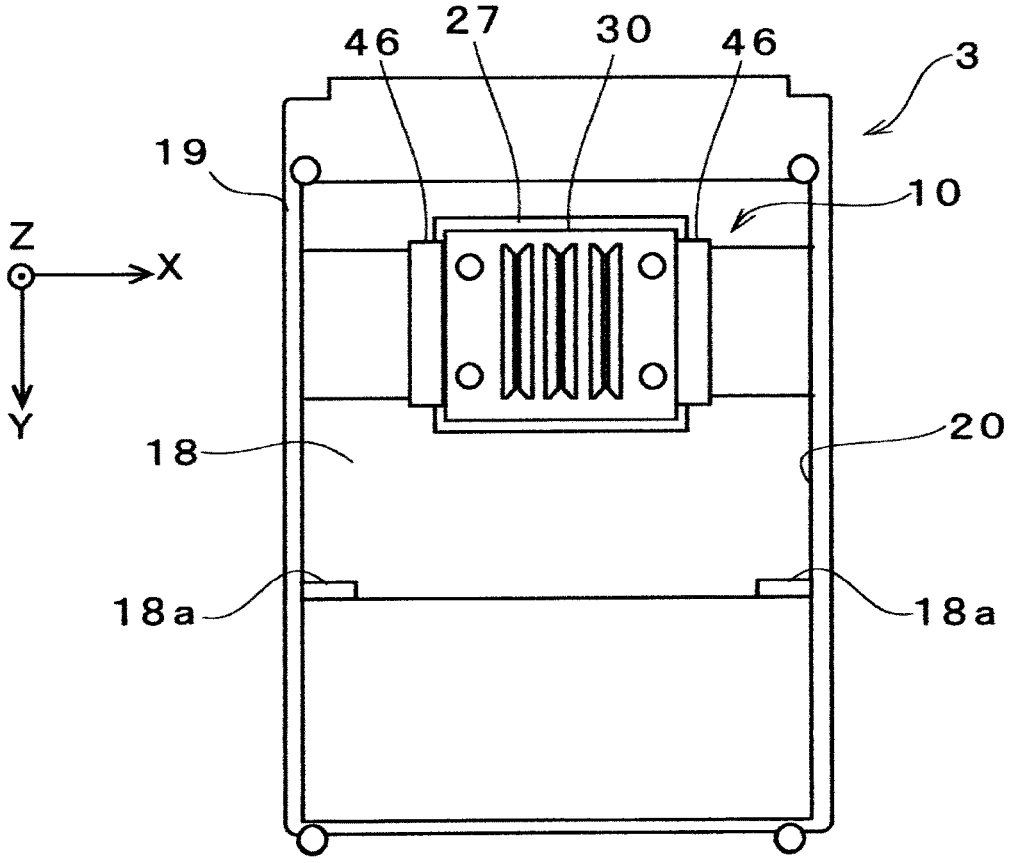
FIG. 10 is a plan view of a holder according to a second exemplary embodiment.
Figure 11:
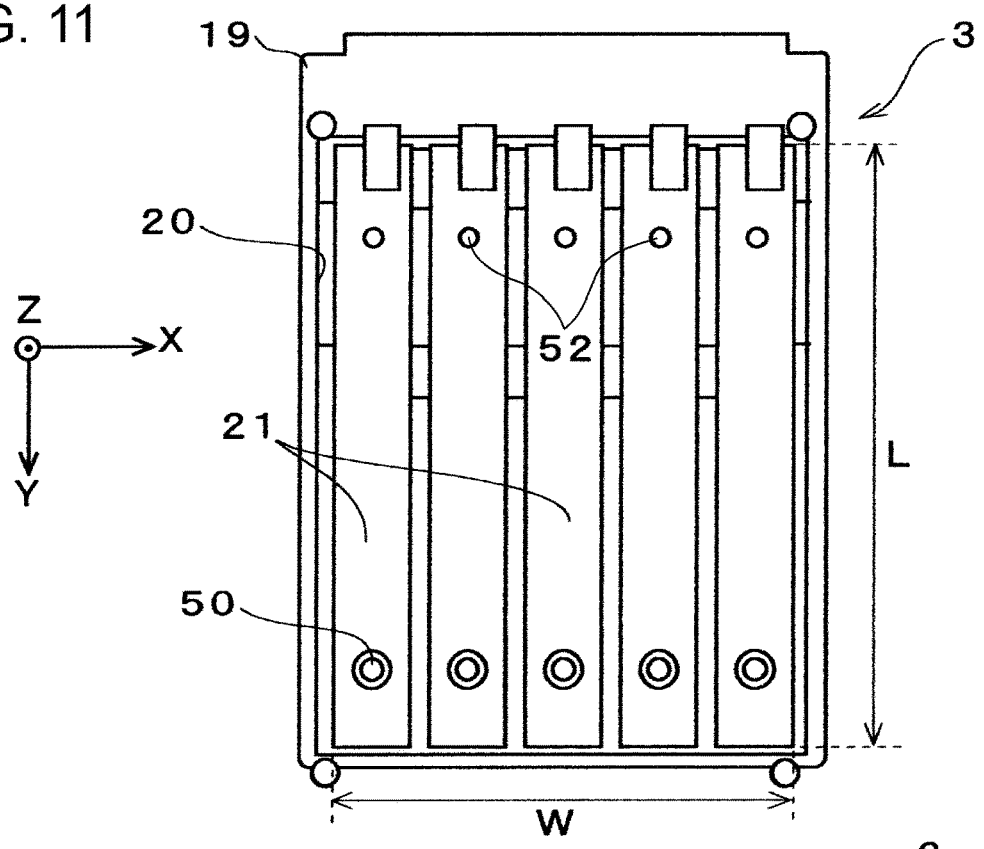
FIG. 11 is a plan view of the holder according to the second exemplary embodiment.
Figure 12:
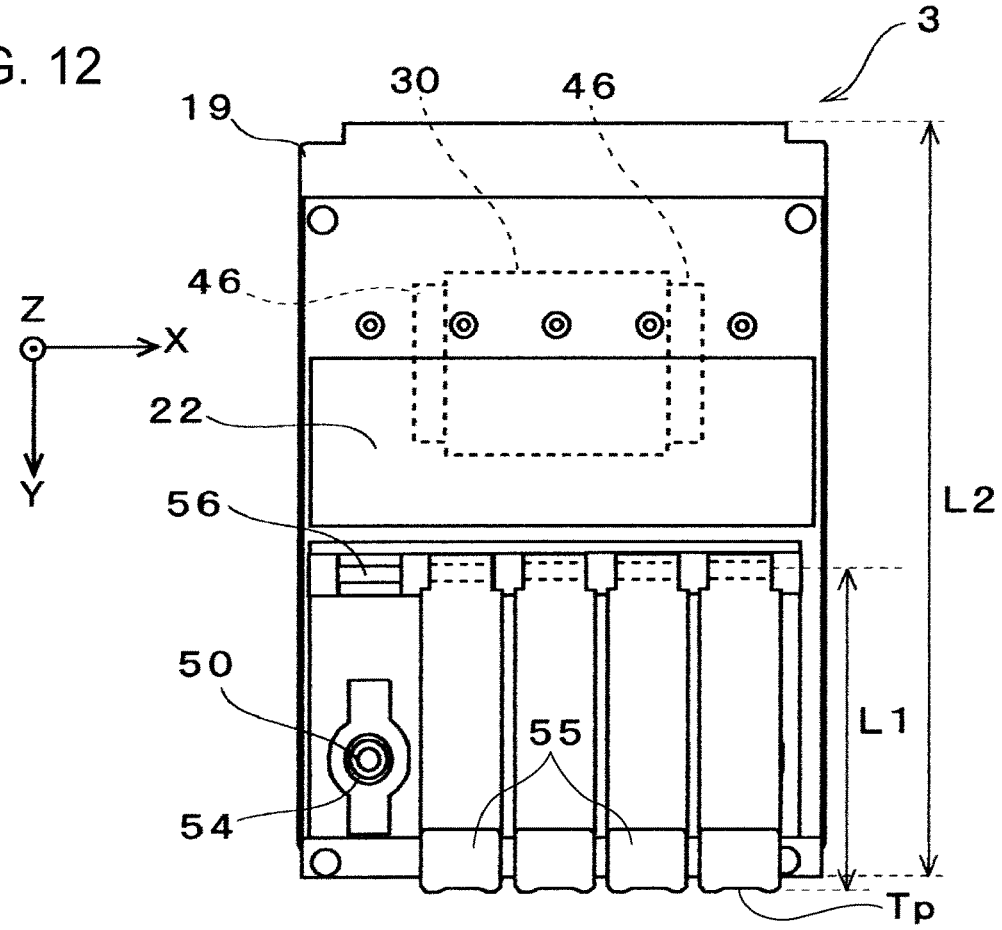
FIG. 12 is a plan view of the holder according to the second exemplary embodiment.

FIGS. 10 to 12 are plan views illustrating a configuration of the holder 3 according to a second exemplary embodiment of the present disclosure. FIG. 10 illustrates a state in which the liquid ejecting head 10 has been disposed in the holder 3, FIG. 11 illustrates a state in which the liquid storing member 21 has been disposed, and FIG. 12 illustrates a state in which the lid member 22 has been attached. Note that FIG. 12 illustrates a state in which the filling port cover 55 corresponding to the liquid storing member 21, among a plurality of liquid storing members 21 arranged in parallel in the X direction, disposed in the first end portion (the left end in FIG. 12) has been detached. Furthermore, portions common to those of the first exemplary embodiment are denoted with the same reference numerals and description thereof is appropriately omitted. The present exemplary embodiment is different from the first exemplary embodiment in that a plurality of liquid storing members 21 are mounted side by side in the X direction in the housing space 20 of the holder 3, and in that the filling ports 50 of the liquid storing members 21 are arranged side by side in the X direction. In the configuration illustrated as an example, a total of five liquid storing members 21 each shaped so as to be long in the Y direction and short in the X direction are mounted side by side in the X direction. The liquid storing members 21 each store ink of different types (different colors, for example).

Pitches at which the liquid storing members 21 are disposed in the X direction and pitches at which the introduction needles 47 of the liquid ejecting head 10 are disposed in the X direction match each other in the present exemplary embodiment. The filling port covers 55 of the liquid storing members 21 are attached to a common pivot shaft 56 that extend in the X direction. Furthermore, as illustrated in FIG. 11, a width W of the entire liquid storing members 21 in the X direction, in other words, a dimension between one end of the liquid storing member 21 positioned at the first end portion in the X direction and the other end of the liquid storing member 21 positioned at a second end portion in the X direction, is smaller than a length L of each liquid storing member 21 in the Y direction. With the above, the size of the holder 3 in the X direction can be reduced. Furthermore, since the liquid storing member 21 is long in the Y direction, a larger space, or volume, in storing the ink can be obtained while suppressing the dimension in the X direction. Furthermore, by adopting such liquid storing members 21, a large distance can be obtained between the filling port 50 and the electrical components; accordingly, adhesion of ink to the electrical components when the ink is spilt can be prevented further.

In the present exemplary embodiment as well, the upper opening of the housing space 20 is closed by the lid member 22, in which the opening portions 54 that expose the filling ports 50 of the liquid storing members 21 are provided, while in a state in which the liquid ejecting head 10 and the liquid storing members 21 are attached to the housing space 20 of the holder 3. The filling port covers 55 configured to pivot about the pivot shaft 56 are each attached to the lid member 22 in the present exemplary embodiment as well. The filling port covers 55 are each configured to be displaced, about the pivot shaft 56, between the open position in which the corresponding filling port 50 is open and a closed position in which the corresponding filling port 50 is closed. Accordingly, when the filling port cover 55 is pivoted to the closed position and is closed, the filling port 50 is sealed with the sealing member 57 in a liquid tight manner so that leakage of ink from the filling port 50 and evaporation of the solvent in the ink are suppressed. In the present exemplary embodiment, since the filling port covers 55 of the liquid storing members 21 are attached to the common pivot shaft 56 that extends in the X direction, the distances between the pivot shaft 56 and the filling ports 50 are uniform in the liquid storing members 21; accordingly, the filling port covers 55 used in the liquid storing members 21 can be a common component. As a result, a reduction in cost can be achieved.

In the present exemplary embodiment, a dimension (or a length) L1 of each filling port cover 55 in the Y direction is half or less than half of a dimension L2 of the holder 3 in the Y direction. In other words, the length of the filling port cover 55 can be further shortened. With the above, when the filling port cover 55 is opened to the open position while the body cover 4 is open, since a height from the upper surface of the holder 3 to the distal end Tp of the filling port cover 55 in the Z direction can be suppressed, the filling port cover 55 does not easily interfere with another member, such as the body cover 4 (in a configuration including a scanner that functions as the body cover, the scanner) in the present exemplary embodiment. Furthermore, the cost can be reduced by the amount corresponding to the shortened length of the filling port cover 55. In the present exemplary embodiment, the plurality of liquid storing members 21 are provided in the X direction, the electrical components are disposed at a position deviated from the filling port 50 in plan view, or at a separate position on the first side in the Y direction, and the dimension L1 of the filling port cover 55 in the Y direction is half or less than half of the dimension L2 of the holder 3 in the Y direction; accordingly, the pivot shaft 56 is disposed between the electrical components, such as the circuit substrate 30, and the filling port 50 in the Y direction. Accordingly, when the ink is refilled into each liquid storing member 21, the corresponding refilling container 51 is prevented by the corresponding filling port cover 55 in the open position from, with respect to the pivot shaft 56, entering the first side in the Y direction, and the refilling container 51 is prevented from being positioned above the electrical components. Accordingly, even when the ink is spilt when filling the ink into the filling port 50 from the refilling container 51, the spilt ink can be further prevented from adhering to the electrical components.

Note that in the present exemplary embodiment, a configuration in which the filling port cover 55 is individually provided for each of plurality of liquid storing members 21 has been described as an example; however, not limited to such a configuration, a single filling port cover 55 common to the plurality of liquid storing members 21 can be adopted. Furthermore, a configuration in which an integral colored-ink liquid storing member 21 common to the colored ink such as cyan, magenta, and yellow is used and in which a separate black-ink liquid storing member 21 is used for the black ink can be adopted. The colored-ink liquid storing member 21 can form therein separate storage portions for each color.

Furthermore, in the exemplary embodiments described above, a configuration in which the lid member 22 of the holder 3 is provided with the pivot shaft 56 and the filling port cover 55 has been described as an example; however, not limited to such a configuration, a configuration, for example, in which the lid member 22 is not provided in the holder 3 and in which the pivot shaft 56 and the filling port cover 55 are provided in the liquid storing member 21 can be adopted.

Figure 13:
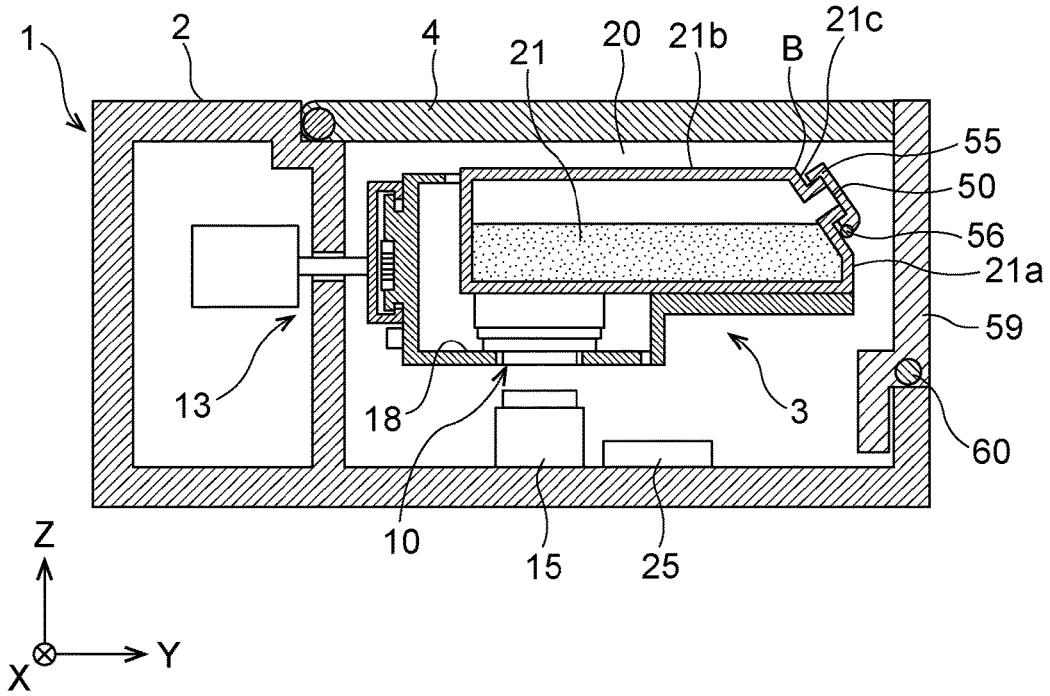
FIG. 13 is a cross-sectional view of a liquid ejecting apparatus according to a third exemplary embodiment.
Figure 14:
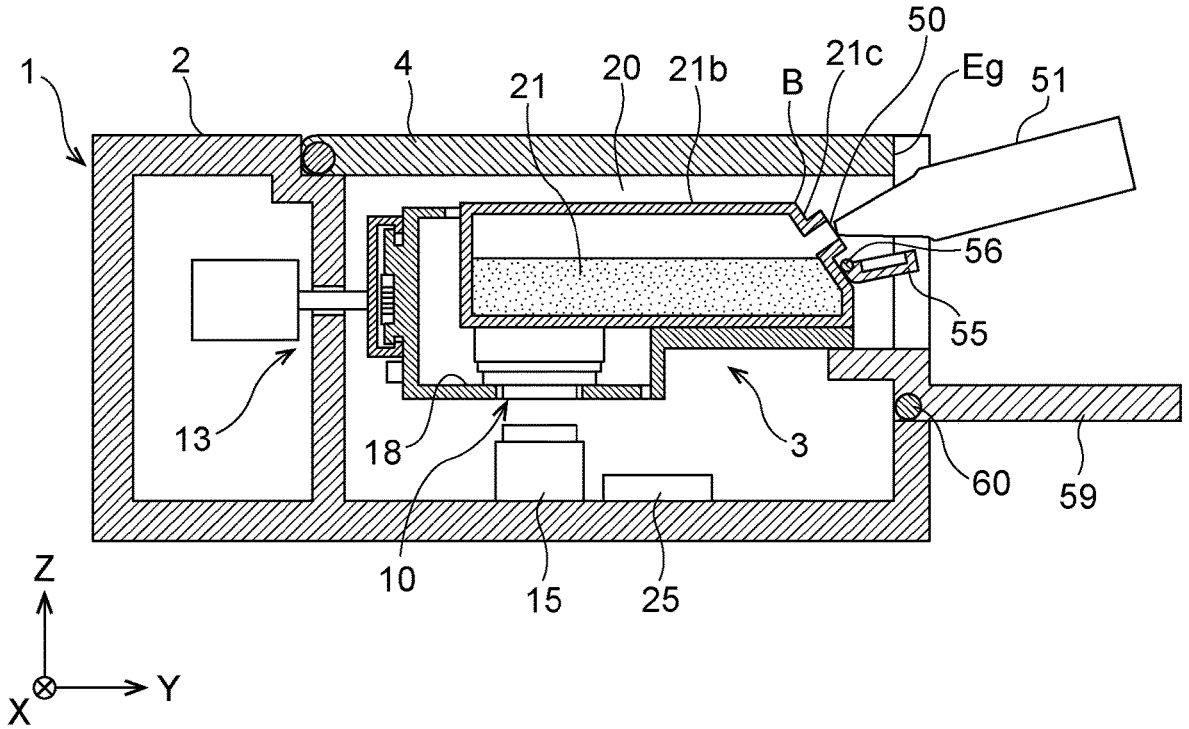
FIG. 14 is a cross-sectional view of the liquid ejecting apparatus according to the third exemplary embodiment.

FIGS. 13 and 14 are cross-sectional views of the liquid ejecting apparatus 1 according to a third exemplary embodiment of the present disclosure. FIG. 13 illustrates a state in which a front cover 59 and the filling port cover 55 are closed, and FIG. 14 illustrates a state in which the front cover 59 and the filling port cover 55 are open. Furthermore, portions common to those of the first exemplary embodiment and the second exemplary embodiment are denoted with the same reference numerals and description thereof is appropriately omitted. Note that while in the present exemplary embodiment, a configuration in which only a single liquid storing member 21 is provided in the holder 3 is described as an example, similar to the second exemplary embodiment described above, a configuration in which a plurality of liquid storing members 21 are provided in the holder 3 can be adopted. In such a case, each of the liquid storing members 21 is configured in the following manner. In the exemplary embodiments described above, a configuration in which the filling port 50 is provided in the upper surface of the liquid storing member 21, or in a top face that is parallel to the nozzle surface (in other words, the nozzle plate 32) of the liquid ejecting head 10 in which the nozzles 35 are formed has been described as an example; however, the disclosure is not limited to the above. The liquid storing member 21 according to the present exemplary embodiment includes a front surface 21*a* on the second side in the Y direction, and an inclined surface 21*c* between the front surface 21*a* and the top face 21*b*. The inclined surface 21*c* is inclined against the front surface 21*a*, the top surface 21*b*, and the nozzle surface.

In the present exemplary embodiment, the filling port 50 is provided in the inclined surface 21*c* of the liquid storing member 21. A virtual central axis of an opening of the filling port 50 and the inclined surface 21*c* are orthogonal to each other. Furthermore, the filling port cover 55 is configured to open towards the second side in the Y direction, or fall towards the user from the viewpoint of the user, about the pivot shaft 56 provided below the filling port 50. Furthermore, the front cover 59 configured to pivot about a front cover pivot shaft 60 is provided in a front surface of the housing 2 according to the present exemplary embodiment. The front cover 59 is also configured to open so as to fall towards the second side in the Y direction about the front cover pivot shaft 60. As illustrated in FIG. 14, when refilling the ink into the filling port 50 from the refilling container 51, the refilling container 51 is inserted into the housing space 20 from the front side of the housing 2 while in a state in which the front cover 59 and the filling port cover 55 are open, and the ink is filled through the filling port 50 in the inclined surface 21*c*.

In the present exemplary embodiment, the inclined surface 21*c* corresponds to a first surface of the present disclosure, and the top face 21*b* that is a surface positioned above the inclined surface 21*c* in the Z direction and that is continuous with the inclined surface 21*c* corresponds to a second surface of the present disclosure. Furthermore, a boundary B between the inclined surface 21*c* and the top face 21*b* is disposed between the electrical components, such as the circuit substrate 30, and the filling port 50 in the Y direction. In other words, since the electrical components are disposed away from the boundary B at a position on the first side in the Y direction, when the ink is filled into the filling port 50 from the refilling container 51, the inclined surface 21*c* becomes an obstacle and the refilling container 51 is prevented from entering the electrical component side. Accordingly, since the refilling container 51 is prevented from being positioned above the electrical components, the ink is further prevented from contacting the electrical components when the ink is spilt. Furthermore, an end portion of the top face of the housing 2 on the second side in the Y direction, in other words, in the present exemplary embodiment, an end portion Eg of the body cover 4 on the second side in the Y direction while the body cover 4 is in the closed state, is provided at a position overlapping the boundary B in plan view in the Z direction or at a position shifted towards the second side in the Y direction from the above position. With the above, the inclined surface 21*c* and the end portion Eg further effectively block the refilling container 51 from entering the electrical component side when the ink is filled into the filling port 50 from the refilling container 51.

Figure 15:
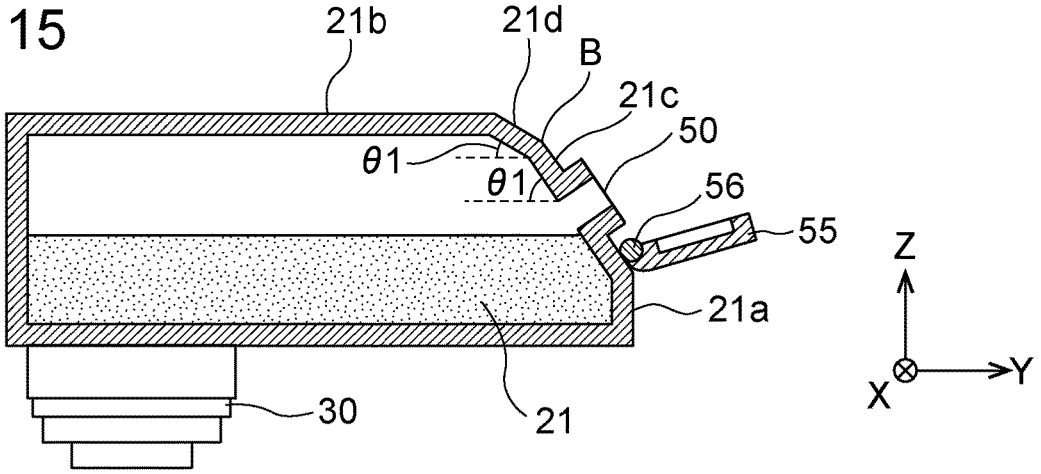
FIG. 15 is a cross-sectional view illustrating a configuration of a liquid storing member according to a first modification of the third exemplary embodiment.

FIG. 15 is a cross-sectional view of the liquid storing member 21 and illustrates a first modification of the third exemplary embodiment. The liquid storing member 21 according to the present modification includes two inclined surfaces 21*c* and 21*d* that have different angle values and that are positioned between the front surface 21*a* and the top face 21*b*. An inclination angle θ1 of the inclined surface 21*c* against the XY plane parallel to the nozzle surface is larger than an inclination angle θ2 of the inclined surface 21*d* against the XY plane. Furthermore, the filling port 50 is provided in, between the above inclined surfaces, the inclined surface 21*c* at a lower position in the Z direction, or at a position closer to the front surface 21*a*. In such a configuration, the inclined surface 21*d* that is positioned above the inclined surface 21*c* in the Z direction and that is a surface that joins the inclined surface 21*c* in a continuous manner corresponds to the second surface of the present disclosure. Furthermore, a boundary B between the inclined surface 21*c* and the inclined surface 21*d* is disposed between the electrical components, such as the circuit substrate 30, and the filling port 50 in the Y direction. In a configuration describe above that includes, between the front surface 21*a* and the top face 21*b* in the Z direction, a plurality of inclined surfaces that have different angle values, when the ink is filled into the filling port 50 from the refilling container 51, the inclined surfaces both become obstacles and, accordingly, the refilling container 51 is further effectively prevented from entering the electrical component side.

Figure 16:
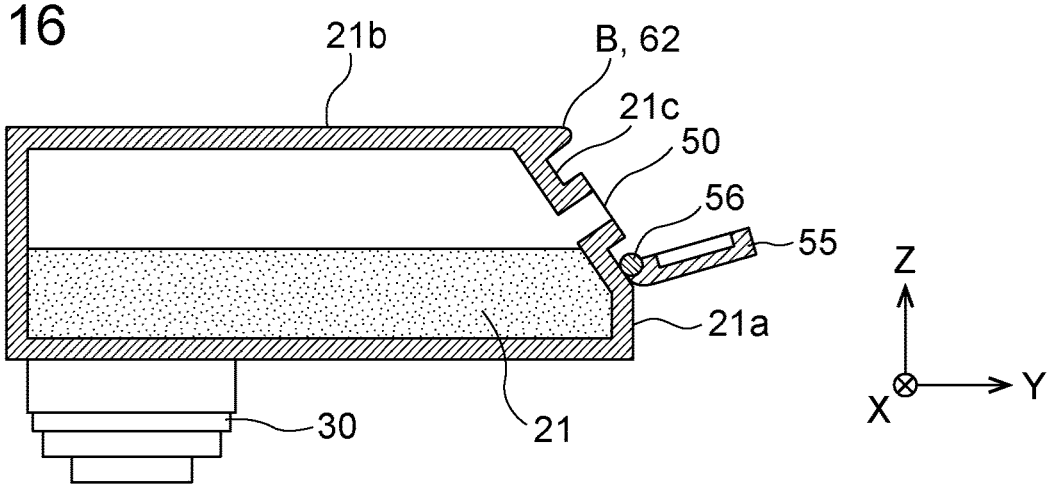
FIG. 16 is a cross-sectional view illustrating a configuration of a liquid storing member according to a second modification of the third exemplary embodiment.

FIG. 16 is a cross-sectional view of the liquid storing member 21 and illustrates a second modification of the third exemplary embodiment. The liquid storing member 21 according to the present modification includes a protrusion 62, which protrudes in a direction orthogonal to the inclined surface 21*c*, at the boundary B between the inclined surface 21*c* and the top face 21*b*. In such a configuration, when the ink is filled into the filling port 50 from the refilling container 51, the refilling container 51 is prevented by the protrusion 62 from entering the electrical component side; accordingly, even when the ink is spilt when filling the ink into the filling port 50 from the refilling container 51, the spilt ink can be prevented in a further effective manner from adhering to the electrical components.

Figure 17:
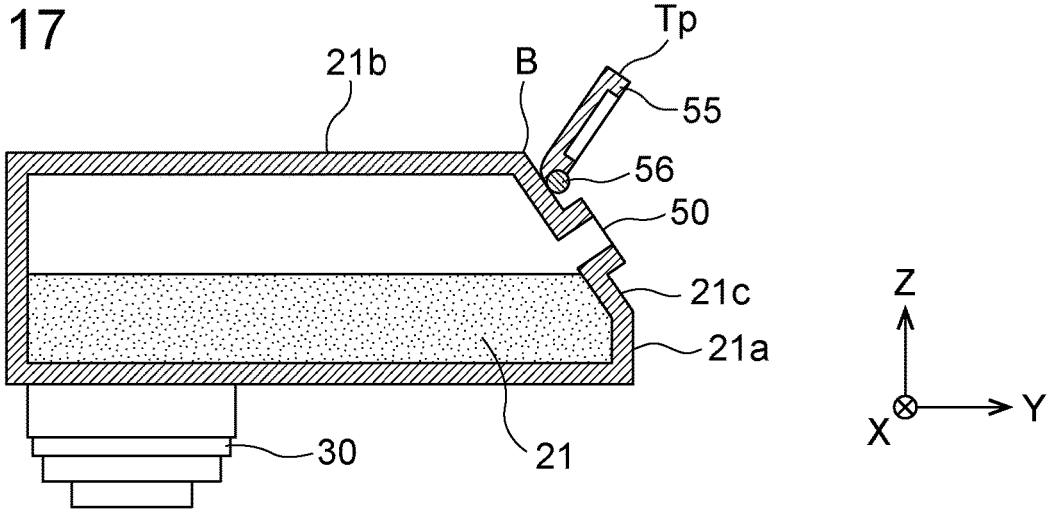
FIG. 17 is a cross-sectional view illustrating a configuration of a liquid storing member according to a third modification of the third exemplary embodiment.

FIG. 17 is a cross-sectional view of the liquid storing member 21 and illustrates a third modification of the third exemplary embodiment. The filling port cover 55 according to the present modification is, in the inclined surface 21*c*, configured to open towards the second side in the Y direction, or to lift the distal end Tp towards the user from the viewpoint of the user, about the pivot shaft 56 provided above the filling port 50. In such a configuration, the distal end Tp of the filling port cover 55 opposite the end portion attached to pivot shaft 56 is, when in the open position, positioned between the electrical components, such as the circuit substrate 30, and the filling port 50 in the Y direction. In such a configuration, the filling port cover 55 becomes a block that prevents the refilling container 51 from entering the electrical component side when the ink is filled into the filling port 50 from the refilling container 51. Accordingly, since the refilling container 51 is prevented from being positioned above the electrical components, the ink is further prevented from contacting the electrical components when the ink is spilt. Note that in the above configuration, desirably, the filling port cover 55 in the open position does not come in contact with the body cover 4 of the housing 2.

Figure 18:
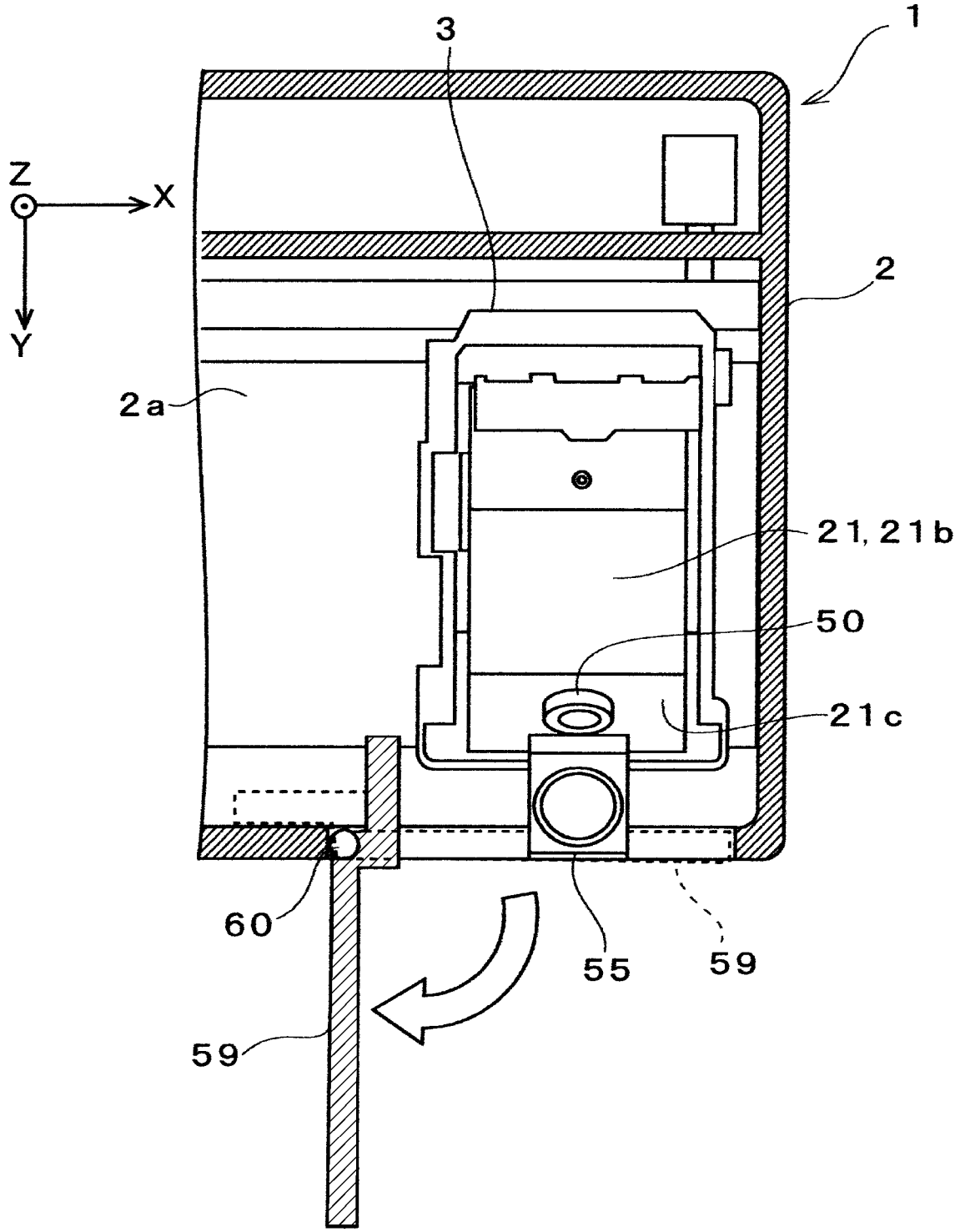
FIG. 18 is a plan view illustrating an inside configuration of a liquid ejecting apparatus according to a fourth modification of the third exemplary embodiment.

FIG. 18 is a plan view illustrating an internal configuration of the liquid ejecting apparatus 1 and illustrates a fourth modification of the third exemplary embodiment. In the present modification, the front cover pivot shaft 60 is provided so as to extend in the Z direction, or is provided so as to be oriented orthogonal to the nozzle surface of the liquid ejecting head 10 or the bottom portion 2*a* of the housing 2, and is provided on the first side in the X direction with respect to the filling port 50 of the liquid storing member 21 at the ink filling position, in other words, the front cover pivot shaft 60 is provided so as to be deviated towards the print area during the printing operation. Furthermore, the front cover 59 is configured to open, among the front surface of the housing 2, the portion corresponding to the liquid storing member 21 by pivoting about the front cover pivot shaft 60 clockwise (the direction indicated by the arrow in the drawing) in plan view in the Z direction from the state (the state illustrated by a broken line in FIG. 18) in which the front surface of the housing 2 is closed. Note that the position of the front cover pivot shaft 60 is not limited to the position illustrated as an example in FIG. 18. The front cover pivot shaft 60 may be positioned so as to be deviated towards the second side in the X direction with respect to the filling port 50 of the liquid storing member 21 in the ink filling position so as to have the filling port 50 between the position illustrated as an example in FIG. 18 and the front cover pivot shaft 60. In the above case, the front cover 59 is configured to open, among the front surface of the housing 2, the portion corresponding to the liquid storing member 21 by pivoting counterclockwise in plan view in the Z direction from the state in which the front surface of the housing 2 is closed.

Figure 19:
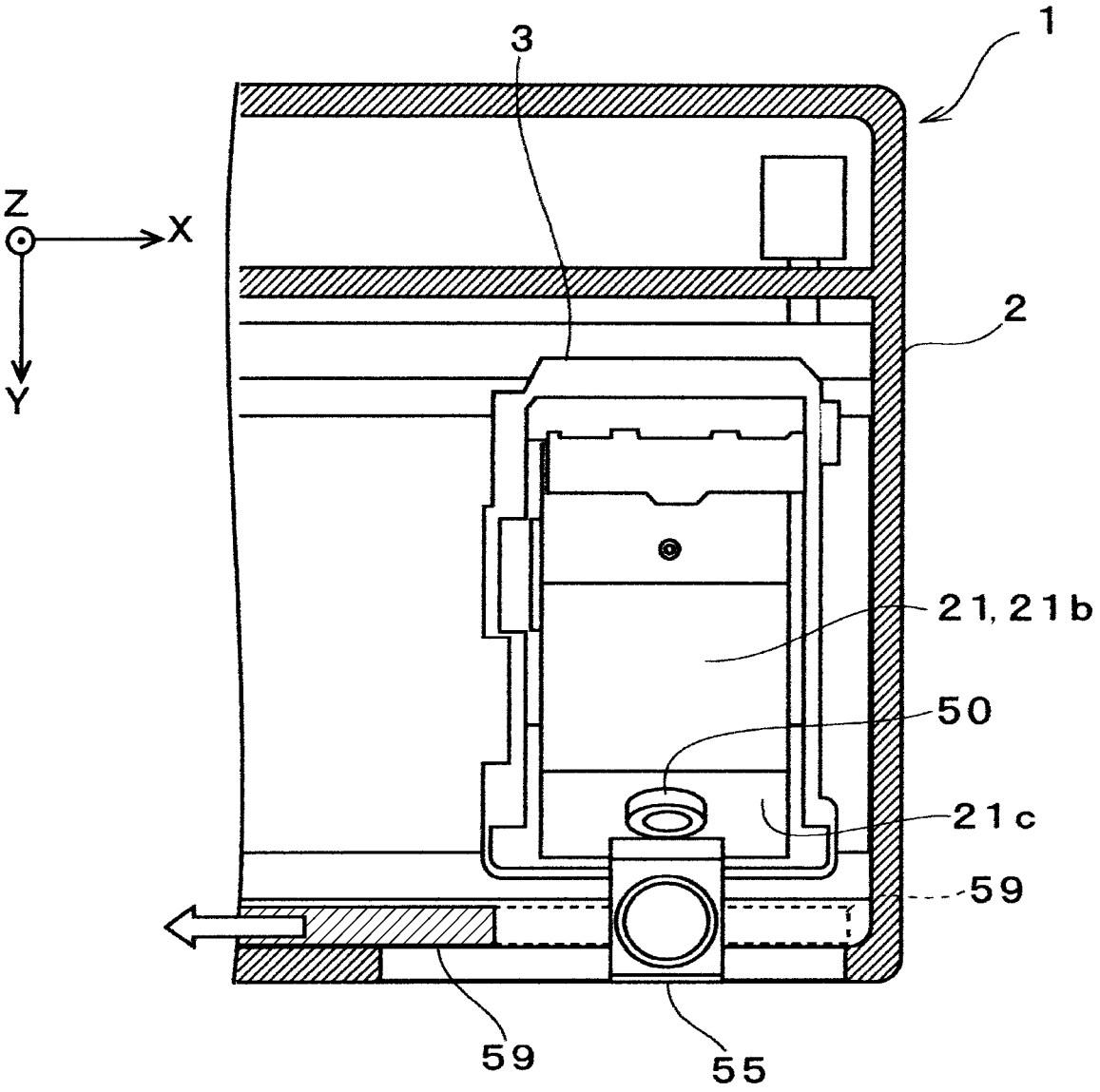
FIG. 19 is a plan view illustrating an inside configuration of a liquid ejecting apparatus according to a fifth modification of the third exemplary embodiment.

FIG. 19 is a plan view illustrating an internal configuration of the liquid ejecting apparatus 1 and illustrates a fifth modification of the third exemplary embodiment. In the present modification, the front cover 59 is configured to open/close by sliding in the X direction. In other words, the front cover 59 is configured to open, among the front surface of the housing 2, the portion corresponding to the liquid storing member 21 by sliding towards the first side in the X direction from a state in which the front surface of the housing 2 is closed (the state indicated by a broken line in FIG. 19).

In the exemplary embodiments described above, the circuit substrate 30 is layered in the liquid ejecting head 10 in the Z direction; however, the circuit substrate 30 may be disposed along the lateral wall 19 of the holder 3. Furthermore, the circuit substrate 30 and the wiring member 38 may be coupled to each other through an FFC, an FPC, or the like. Note the wiring such as the FFC, the FPC, or the like that couples the circuit substrate 30 and the wiring member 38 to each other is an electrical component to which adhesion of the liquid is to be avoided.

Furthermore, while the exemplary embodiments described above are configured as a so-called serial liquid ejecting head in which the holder 3 reciprocates in the X direction that is orthogonal to the Y direction, or the transport direction of the medium M, the exemplary embodiments described above can be configured as a so-called line head in which the length of the liquid ejecting head 10 is equivalent to or longer than the width direction dimension of the medium M.

Furthermore, while the ink jet recording apparatus (the printer) on which the ink jet recording head, which is a type of a liquid ejecting head, has been described above as a form of the liquid ejecting apparatus, the present disclosure may be applied to other liquid ejecting apparatuses that include in a holder, together with a liquid ejecting head and an electrical component, a liquid storing member that is provided with a filling port through which a liquid can be refilled. For example, the present disclosure can also be applied to a liquid ejecting head including a plurality of color material ejecting heads used to manufacture color filters of liquid crystal displays and the like, a plurality of electrode material ejecting heads used to form electrodes of organic electroluminescence (EL) displays and field emission displays (FED), a plurality of bio organic matter ejecting heads used to manufacture biochips (biotips), or the like, and to a liquid ejecting apparatus including the liquid ejecting head.

Technical ideas and the effects perceived from the exemplary embodiments and the modifications described above will be described below.

The liquid ejecting apparatus of the present disclosure is proposed to achieve the above described object and includes a liquid ejecting head that ejects a liquid through the nozzle by driving the drive element, an electrical component electrically coupled to the drive element, a liquid storing member that includes a filling port configured to have the liquid from a refilling container filled therethrough, the liquid storing member receiving and storing the liquid through the filling port, and a holder in which the liquid ejecting head, the electrical component, and the liquid storing member are mounted, in which the electrical component is disposed at a position deviated from the filling port in plan view (a first configuration).

In the present disclosure, even when the liquid were to be spilt to a portion external to the liquid storing member when filling the liquid into the filling port from the refilling container, the spilt liquid can be prevented from adhering to the electrical component. As a result, shortcomings such as short-circuiting due to adhesion of the liquid to the electrical component can be prevented from occurring.

Desirably, in the first configuration described above, a configuration is adopted in which a cover that pivots about a pivot shaft and that covers the filling port is provided, and the pivot shaft is disposed between the electrical component and the filling port in a first direction that is a transport direction of a medium at a position opposing the nozzle (a second configuration).

According to such a configuration, when the liquid is refilled into the liquid storing member, the refilling container is prevented by the cover from entering the first side with respect to the pivot shaft, the refilling container is prevented from being positioned above the electrical component. Accordingly, even when the liquid is spilt when filling the liquid into the filling port from the refilling container, the spilt liquid can be prevented further from adhering to the electrical component.

Desirably, in the first or second configuration described above, a configuration is adopted in which a cover that covers the filling port is provided, in which the cover is configured to be displaced about the pivot shaft and displaced between an open position in which the filling port is open, and a closed position in which the filling port is closed, and in the open position, a distal end of the cover opposite an end portion of the cover attached to the pivot shaft is positioned between the electrical component and the filling port in a first direction that is a transport direction of a medium at a position opposing the nozzle (a third configuration).

With such a configuration, the cover becomes a block that prevents the refilling container from entering the electrical component side when the liquid is filled into the filling port from the refilling container. Accordingly, since the refilling container is prevented from being positioned above the electrical component, the liquid is further prevented from contacting the electrical component when the liquid is spilt.

Desirably, in the second or the third configuration described above, a configuration is adopted in which a dimension of the cover in the first direction is half or less than half of a dimension of the holder in the first direction (a fourth configuration).

According to such a configuration, interference with the other members becomes difficult when the cover is in the open position. Furthermore, the cost can be reduced by the amount corresponding to the shortened length of the cover.

Furthermore, the liquid storing member according to any one of the first to fourth configurations described above is desirably configured to include a first surface in which the filling port is provided, the first surface extending in a direction intersecting a nozzle surface of the liquid ejecting head in which the nozzle is provided, and a second surface positioned above the first surface, the second surface being a surface that is continuous with the first surface and that extends in a direction intersecting the first surface, in which a boundary between the first surface and the second surface is disposed between the electrical component and the filling port in a first direction that is a transport direction of a medium at a position opposing the nozzle (a fifth configuration).

With such a configuration, since the boundary between the first surface and the second surface is disposed between the electrical component and the filling port in a first direction, the first surface prevents the refilling container from entering the electrical component side when the liquid is filled into the filling port from the refilling container. Accordingly, since the refilling container is prevented from being positioned above the electrical component, the liquid is further prevented from contacting the electrical component when the liquid is spilt.

Furthermore, the liquid ejecting apparatus according to any one of the second to fifth configuration described above can adopt a configuration including a housing that houses the liquid ejecting head, the holder, and the liquid storing member in a housing space and including a body cover that pivots about a body cover pivot shaft disposed on a first side in the first direction to open/close the housing space, in which the filling port is disposed on a second side in the first direction with respect to the electrical component (a sixth configuration).

With such a configuration, even when the liquid were to be spilt to a portion external to the liquid storing member when filling the liquid into the filling port from the refilling container, the spilt liquid can be prevented from adhering to the electrical component. As a result, shortcomings such as short-circuiting due to adhesion of the liquid to the electrical component can be prevented from occurring.

Furthermore, in any one of the first to sixth configurations described above, a configuration can be adopted in which the plurality of the liquid storing members are provided side by side in a second direction that intersects a first direction that is a transport direction of a medium at a position opposing the nozzle (a seventh configuration).

With such a configuration, the filling ports of the liquid storing members and the electrical component are disposed more easily at positions away from each other in the first direction compared to disposing the plurality of liquid storing members in the first direction. Accordingly, even when the liquid were to be spilt to a portion external to the liquid storing member when filling the liquid into the filling port from the refilling container, the spilt liquid can be prevented from adhering to the electrical component. As a result, shortcomings such as short-circuiting due to adhesion of the liquid to the electrical component can be prevented from occurring.

In the seventh configuration described above, a configuration can be adopted in which the filling port of the plurality of the liquid storing members is disposed side by side in the second direction, and the plurality of the covers of the plurality of the liquid storing members are each attached to a common pivot shaft that extends in the second direction (an eighth configuration).

With such a configuration, since the cover of each liquid storing member is attached to the common pivot shaft extending in the second direction, the distances from the pivot shaft to the filling ports can be uniform in the liquid storing members. Accordingly, the covers used in the liquid storing members can be a common component.

Furthermore, in any one of the first to eighth configurations described above, a configuration in which the electrical component is a circuit substrate related to the driving of the drive element can be adopted (a ninth configuration).

With such a configuration, even when the liquid were to be spilt to a portion external to the liquid storing member when filling the liquid into the filling port from the refilling container, the spilt liquid can be prevented from adhering to the circuit substrate related to the driving of the drive element.

In the ninth configuration, the electrical component can include wiring that couples a control circuit disposed external to the holder and the circuit substrate to each other (a tenth configuration).

With such a configuration, even when the liquid were to be spilt to a portion external to the liquid storing member when filling the liquid into the filling port from the refilling container, the spilt liquid can be prevented from adhering to the wiring electrically coupling the control circuit disposed external to the holder, and the circuit substrate to each other.

Furthermore, in a tenth configuration described above, the circuit substrate can adopt a configuration including a connection terminal that electrically couples the wiring and the circuit substrate to each other (an eleventh configuration).

With such a configuration, even when the liquid were to be spilt to a portion external to the liquid storing member when filling the liquid into the filling port from the refilling container, the spilt liquid can be prevented from adhering to the connection terminal that electrically couples the wiring and the circuit substrate to each other.

What is claimed is:

1. A liquid ejecting apparatus comprising:

a liquid ejecting head including a nozzle for ejecting liquid by driving a drive element;

an electrical component coupled to the drive element;

a liquid storing member including a filling port for injecting the liquid from a refilling container therethrough, the liquid storing member receiving and storing the liquid through the filling port; and a holder mounting the liquid ejecting head, the electrical component, and the liquid storing member, wherein the electrical component and the filling port do not overlap each other in plan view.

2. The liquid ejecting apparatus according to claim 1, further comprising:

a cover that pivots about a pivot shaft and that covers the filling port, wherein the pivot shaft is disposed between the electrical component and the filling port in a first direction that is a transport direction of a medium.

3. The liquid ejecting apparatus according to claim 2, wherein the cover is configured to be displaced about the pivot shaft and displaced between an open position in which the filling port is open, and a closed position in which the filling port is closed, the cover includes an end portion attached to the pivot shaft, and a distal end opposite to the end portion of that, and when the cover is in the open position, the distal end of the cover is located between the electrical component and the filling port in a first direction that is a transport direction of a medium.

4. The liquid ejecting apparatus according to claim 3, wherein a dimension of the cover in the first direction is half or less than half of a dimension of the holder in the first direction.

5. The liquid ejecting apparatus according to claim 2, wherein a dimension of the cover in the first direction is half or less than half of a dimension of the holder in the first direction.

6. The liquid ejecting apparatus according to claim 2, further comprising:

a housing that houses the liquid ejecting head, the holder, and the liquid storing member in a housing space and that includes a body cover that pivots about a body cover pivot shaft disposed on a first side in the first direction to open/close the housing space, wherein the filling port is disposed on a second side in the first direction with respect to the electrical component.

7. The liquid ejecting apparatus according to claim 1, further comprising:

a cover covering the filling port, wherein the cover is configured to be displaced about a pivot shaft and displaced between an open position in which the filling port is open, and a closed position in which the filling port is closed, the cover includes an end portion attached to the pivot shaft, and a distal end opposite to the end portion of that, and when the cover is in the open position, the distal end of the cover is located between the electrical component and the filling port in a first direction that is a transport direction of a medium.

8. The liquid ejecting apparatus according to claim 7, wherein a dimension of the cover in the first direction is half or less than half of a dimension of the holder in the first direction.

9. The liquid ejecting apparatus according to claim 1, wherein the liquid storing member includes, a first surface in which the filling port is provided, the first surface extending in a direction intersecting a nozzle surface of the liquid ejecting head in which the nozzle is provided, and a second surface located above the first surface, the second surface being a surface that is continuous with the first surface and that extends in a direction intersecting the first surface, wherein a boundary between the first surface and the second surface is disposed between the electrical component and the filling port in a first direction that is a transport direction of a medium.

10. The liquid ejecting apparatus according to claim 1, further comprising:

another liquid storing member including another filling port, wherein the liquid storing member and the other liquid storing member are disposed side by side in a second direction that intersects a first direction that is a transport direction of a medium.

11. The liquid ejecting apparatus according to claim 10, further comprising a cover covering the filling port, and another cover covering the other filling port, wherein the filling port and the other filling port are provided side by side in the second direction, and the cover and the other cover are each attached to a common pivot shaft that extends in the second direction and pivot about the pivot shaft.

12. The liquid ejecting apparatus according to claim 1, wherein the electrical component is a circuit substrate related to driving of the drive element.

13. The liquid ejecting apparatus according to claim 12, wherein the electrical component includes wiring that couples a control circuit disposed external to the holder and the circuit substrate to each other.

14. The liquid ejecting apparatus according to claim 13, wherein the circuit substrate includes a connection terminal that couples the circuit substrate with the wiring.

* * * * *